US006520340B1

(12) United States Patent
Niitti

(10) Patent No.: US 6,520,340 B1
(45) Date of Patent: Feb. 18, 2003

(54) METHOD FOR IMPROVING THE OPERATION OF A FLOTATION CELL LINE

(75) Inventor: Timo Niitti, Ponte Vedra, FL (US)

(73) Assignee: Outokumpu Oyj, Espoo (FI)

( * ) Notice: Subject to any disclaimer, the term of this patent is extended or adjusted under 35 U.S.C. 154(b) by 0 days.

(21) Appl. No.: 09/786,995

(22) PCT Filed: Sep. 13, 1999

(86) PCT No.: PCT/FI99/00737

§ 371 (c)(1),
(2), (4) Date: Mar. 12, 2001

(87) PCT Pub. No.: WO00/15344

PCT Pub. Date: Mar. 23, 2000

(51) Int. Cl.[7] ..... B03D 1/00; B03D 1/14; B03B 9/00

(52) U.S. Cl. ..... 209/164; 209/168

(58) Field of Search ..... 209/164, 168, 209/169, 170

(56) References Cited

U.S. PATENT DOCUMENTS 4,121,945 A 10/1978 Hurst et al.

4,477,338 A * 10/1984 Hellmann

FOREIGN PATENT DOCUMENTS

DE 1 197 403 7/1965

OTHER PUBLICATIONS

DECO Trefoil—Technical Bulletin—vol. 26 No. 2 Spring and Summer 1962.*

DECO Trefoil—Technical Bulletin—Sep.–Oct. 1954.*

* cited by examiner

*Primary Examiner*—Thomas M. Lithgow
(74) *Attorney, Agent, or Firm*—Smith-Hill and Bedell

(57) ABSTRACT

The invention relates to a method for improving the operation of a flotation cell line, said flotation cell line comprising several flotation cells (1, 2, 3, 4, 5; 11, 12, 13, 14, 15) that are connected by means of liquid stream flow. According to the invention, at least part of the material flotated in the flotation cell line is conducted past the cell (1, 11) that is located first in the flotation cell line, when seen in the flowing direction (7, 16) of the flotatable material.

8 Claims, 2 Drawing Sheets

METHOD FOR IMPROVING THE OPERATION OF A FLOTATION CELL LINE

Figure 1:
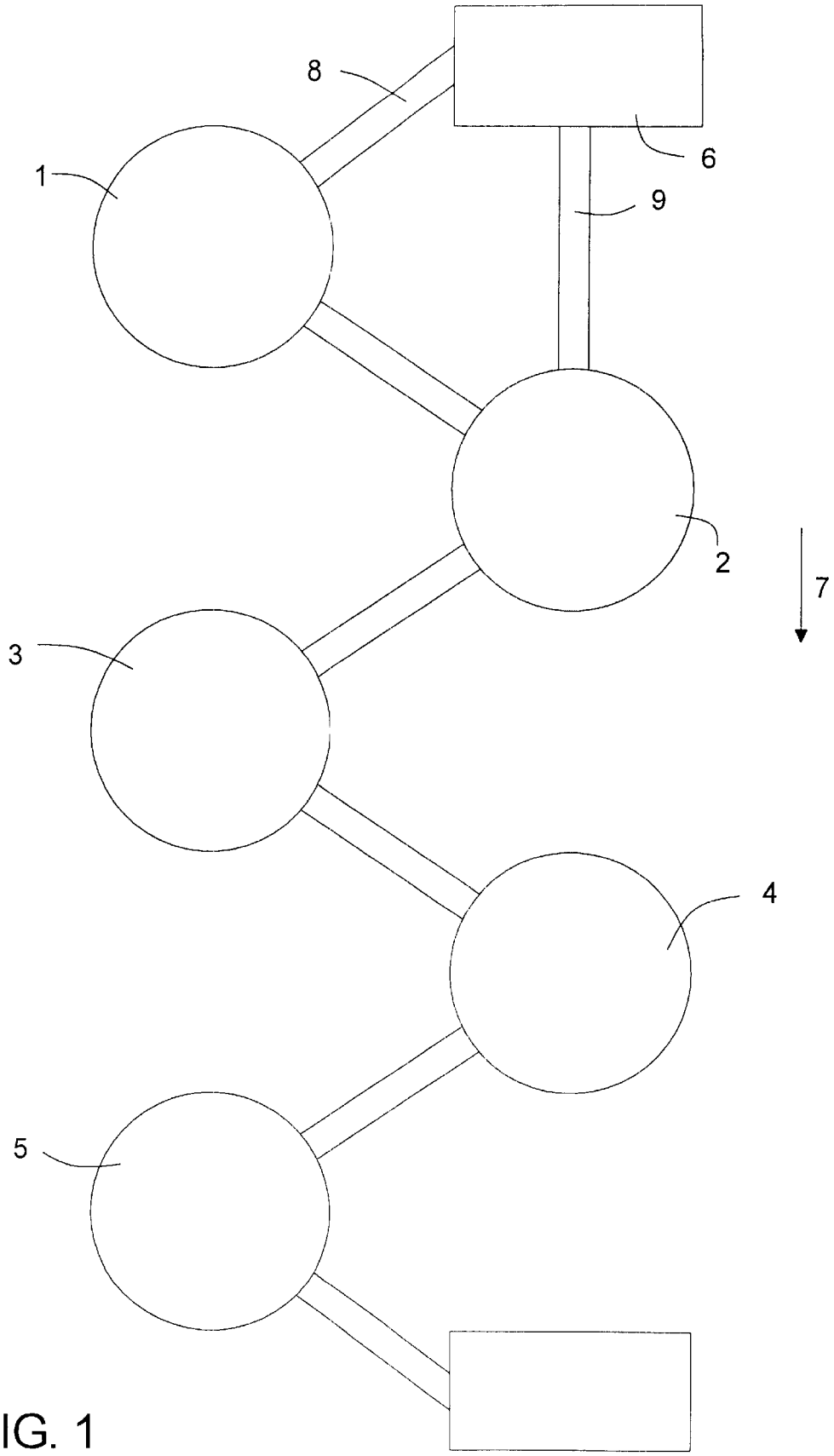

The present invention relates to a method for improving the operation of a flotation cell line, particularly in the beginning of the flotation cell line, when at least part of the flotatable material is fed past the flotation cell that is located first in the flotation cell line, when seen in the flowing direction of the flotatable material.

In a flotation cell, there are treated slurry-like materials in order to remove from the rest of the material the desired ingredients that can be utilized. The main task of the flotation cell is to keep the flotatable material in suspension, to feed air into the suspension and to disperse the suspension into small air bubbles, as well as to conduct the utilizable ingredients, i.e. the concentrate, and the rest of the material, to separate locations. However, with respect to the recovered concentrate, the efficiency of the flotation cell is essentially low. Consequently, in order to achieve the desired degree of concentration for the utilizable ingredient, the flotation cells are usually coupled in series, so that the waste from the preceding flotation cell serves as the feed for the successive flotation cell. The concentrates obtained from the cells of the accordingly created flotation cell line are then combined and conducted to further treatment.

Because the flotation cell line processes a slurry-like material, which already prior to feeding into the flotation cell line is usually treated in several different process stages, the treated slurry-like material often causes fluctuation or disturbances in the flotation cell line feed. In that case the flotation cell line must be dimensioned according to the additional load required by said fluctuations and disturbances. As the size of the flotation cells grows, the effect of said additional load grows further, because when the size of the flotation cells grows, their volume grows in proportion to the third power of the dimensions. On the other hand, the area of the flotation cells only grows in proportion to the quadrature of the longitudinal dimensions. Thus there is often reached a situation where the froth area of the flotation cell restricts the productive capacity of the cell. Said phenomenon is most obvious in a cell that is located first in the flotation cell line, when seen in the flowing direction of the flotatable material.

The object of the present invention is to eliminate some of the drawbacks of the prior art and to improve the efficiency of the flotation cell line, particularly in the beginning of the flotation cell line, where the concentrate recovery obtained from the flotation cell line is most advantageous. The essential novel features of the invention are apparent from the appended claims.

According to the invention, the efficiency of the flotation cell line is improved so that the feed, i.e. the flotatable material, fed into the flotation cell line is distributed into the flotation cell line so that at least part of the flotatable material is conducted past the cell located first in the flotation cell line, when seen in the flowing direction of the flotatable material, to at least one flotation cell that is located next in succession to the cell located first in the flotation cell line, when seen in the flowing direction of the flotatable material. This procedure prevents a situation where the fluctuations and disturbances in the feed only affect the first cell in the flotation cell line. Simultaneously it prevents any drawbacks that are caused by a possible insufficiency of the froth area of the first cell in the flotation cell line.

The improving of the efficiency of the flotation cell line according to the invention, by feeding the material to be flotated in the flotation cell line to at least two flotation cells located in the flotation cell line can be carried out so that into the first cell in the flotation cell line, when seen in the flowing direction of the flotatable material, the flotatable material is fed in a flow that is essentially homogeneous in volume. Consequently any flows that surpass said desired, essentially equally large flow of the flotatable material are conducted past the cell located first in the flotation cell line when seen in the flowing direction of the flotatable material, to another cell located in the flotation cell line. Thus any possible fluctuations and disturbances in the feeding of the flotatable material, caused by the pre-flotation process stages, can advantageously be eliminated, because in the cell located first in the flotation cell line, when seen in the flowing direction of the flotatable material, there can be created conditions that are profitable for flotation. Because flotation in general is most advantageous in the cell located first in the flotation cell line, when seen in the flowing direction of the flotatable material, by following the feeding method according to the invention there are avoided any drawbacks resulting from the fluctuations and disturbances in the feed of the flotatable material, and thus the operation in the beginning of the flotation cell line is improved.

According to the invention, the feeding of the Rotatable material can also be carried out so that the flotatable material is fed in an essentially equally large flow both to the cell located first in the flotation cell line, when seen in the flowing direction of the flotatable material, and to at least one flotation cell located in succession to said first flotation cell. Thus, when feeding the flotatable material advantageously to the first and second cells in the flotation cell line, when seen in the flowing direction of the flotatable material, essentially half of the material to be fed can be fed into both flotation cells. At the same time, the flotation period obtained for the whole material is doubled. Because the flotatable material is thus distributed between several flotation cells, each flotation cell to which non-flotated material is fed, consequently serves as the first primary flotation stage for the flotatable material. Thus the quantity of the flotatable material in the flotation cells of the flotation cell line that are successive to the primary flotation stage can be decreased, because in general the efficiency of the flow is highest in the cell of the flotation cell line that is located first in the flowing direction of the flotatable material. When the quantity of the material to be flotated in the flotation cell line is thus decreased, the control of the flotation cell line according to the invention and at the same time the control of the individual flotation cells contained in the flotation cell line is improved in order to obtain an advantageous flotation yield. As the quality of the concentrate obtained from the flotation cell line can be effectively adjusted, also the capacity of the flotation cell line can advantageously be increased.

According to the invention, into the first cell of the flotation cell line, when seen in the flowing direction of the flotatable material, there is advantageously fed fotatable material in a flow of a predetermined quantity. Any amount of the flotatable material that surpasses said predetermined quantity is advantageously conducted to the cell located second in the flotation cell line, when seen in the flowing direction of the flotatable material, said second cell being coupled either in series or in parallel with the cell located first in the flotation cell line when seen in the flowing direction.

According to the invention, the flotatable material can also be fed so that into the flotation cell located second in the flowing direction of the flotatable material, there is fed flotatable material in a flow of a predetermined quantity, and the rest of the flotatable material is fed into the flotation cell located first in the flowing direction.

Figure 2:
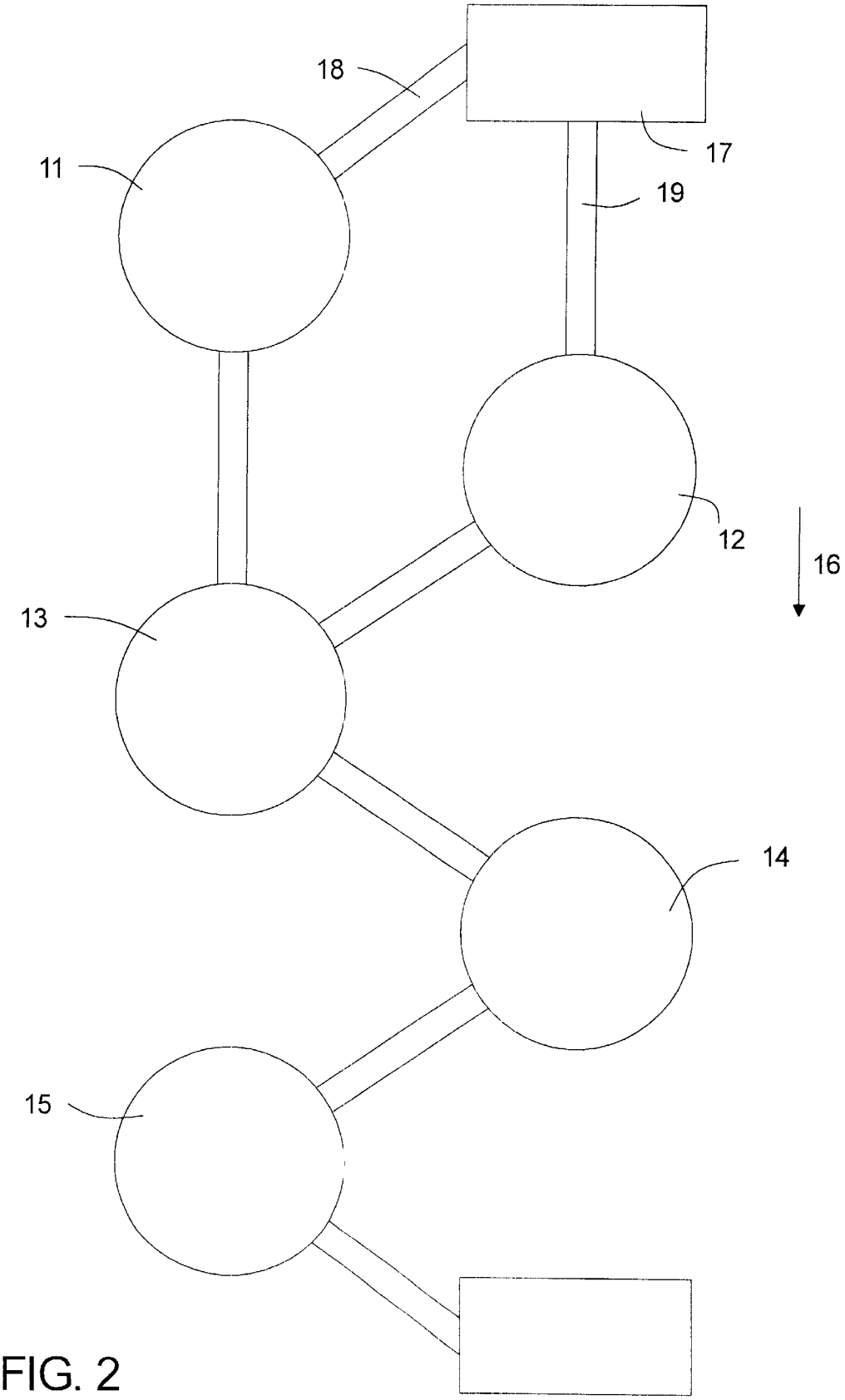

The invention is explained in more detail with respect to the appended drawings, where FIG. 1 is a schematical top-view illustration of a preferred embodiment of the invention, and FIG. 2 is a schematical top-view illustration of another preferred embodiment of the invention.

According to FIG. 1, the flotation cells 1, 2, 3, 4 and 5 are installed in a flotation cell line, whereto the flotatable material is fed from the feeding device 6. In between the feeding device 6 and the first 1 and second 2 flotation cell located in the flowing direction 7 of the flotatable material, there are provided conduits 8 and 9 in order to feed the flotatable material. The conduit 8 in between the feeding device 6 and the first flotation cell 1 is adjusted to operate so that via the conduit 8, only a flow that is smaller than the predetermined material flow, is allowed to flow in to the first flotation cell I. When the material flow allowed for the conduit 8 is surpassed, the surpassing part of the flow is conducted, via the conduit 9, directly to the flotation cell 2, located second in the flowing direction 7 of the Rotatable material. Because part of the material is removed as concentrate from the first flotation cell 1, the material left non-flotated in the first flotation cell 1 can be further conducted to the flotation cell 2 located second in the flowing direction of the flotatable material, whereto also the non-flotated material that surpasses the quantity allowed for the conduit 8 is conducted via the conduit 9. Thus the first and second cells 1 and 2 of the flotation cell line, when seen in the flowing direction 7 of the flotatable material, are installed in series with respect to each other.

According to FIG. 2, the flotation cells 11, 12, 13, 14 and 15 forming the flotation cell line are arranged, with respect to each other, so that the first two flotation cells 11 and 12, when seen in the flowing direction 16 of the flotatable material, are installed in parallel, whereas the rest of the flotation cells 13, 14 and 15 are installed in series both with respect to each other and with respect to the flotation cells 11 and 12. From the feeding device 17, the flotatable material is conducted both via the conduit 18 of the flotation cell 11 and via the conduit 19 of the flotation cell 12, so that essentially about half of the feed of the flotation cell line flows to both flotation cells 11 and 12. Now the obtained concentrate in the two first cells 11 and 12 of the flotation cell line is advantageously distributed between two flotation cells 11 and 12 in an essentially equal fashion, which from the point of view of usage improves the operation of the flotation cell line.

What is claimed is:

1. A method of operating a flotation cell line that has a flotation cell line inlet means for receiving feed material to be processed in the flotation cell line and comprises an upstream flotation cell and at least first and second downstream flotation cells, each flotation cell having an inlet means for receiving feed material to be processed in the respective flotation cell and an outlet means for discharging waste material from the respective flotation cell, the outlet means of the upstream flotation cell being connected to the inlet means of the first downstream flotation cell and the outlet means of the first downstream flotation cell being connected to the inlet means of the second downstream flotation cell, said method comprising, in a first mode of operation, connecting the inlet means of the flotation cell line to the inlet means of the upstream flotation cell, supplying waste material of the upstream flotation cell as feed material to the first downstream flotation cell, and supplying waste material of the first downstream flotation cell as feed material to the second downstream flotation cell, whereby the feed material passes successively through the upstream flotation cell and the first and second downstream flotation cells, and in a second mode of operation, connecting the inlet means of the flotation cell line directly to the inlet means of at least one of said downstream flotation cells and supplying feed material of the flotation cell line directly to said one downstream flotation cell, whereby the feed material that is fed directly to the inlet means of said one downstream flotation cell by-passes the upstream flotation cell, and the method comprising, in the second mode of operation, supplying feed material to the inlet means of the upstream flotation cell at a predetermined material flow rate and supplying any excess feed material received at the inlet means of the flotation cell line directly to the inlet means of the first downstream flotation cell.

2. A method of operating a flotation cell line that has a flotation cell line inlet means for receiving feed material to be processed in the flotation cell line and comprises an upstream flotation cell and at least first and second downstream flotation cells, each flotation cell having an inlet means for receiving feed material to be processed in the respective flotation cell and an outlet means for discharging waste material from the respective flotation cell, the outlet means of the upstream flotation cell being connected to the inlet means of the first downstream flotation cell and the outlet means of the first downstream flotation cell being connected to the inlet means of the second downstream flotation cell, said method comprising, in a first mode of operation, connecting the inlet means of the flotation cell line to the inlet means of the upstream flotation cell, supplying waste material of the upstream flotation cell as feed material to the first downstream flotation cell, and supplying waste material of the first downstream flotation cell as feed material to the second downstream flotation cell, whereby the feed material passes successively through the upstream flotation cell and the first and second downstream flotation cells, and in a second mode of operation, connecting the inlet means of the flotation cell line directly to the inlet means of at least one of said downstream flotation cells and supplying feed material of the flotation cell line directly to said one downstream flotation cell, whereby the feed material that is fed directly to the inlet means of said one downstream flotation cell by-passes the upstream flotation cell, and the method comprising, in the second mode of operation, supplying feed material to the inlet means of the first downstream flotation cell at a predetermined material flow rate and supplying any excess feed material received at the inlet means of the flotation cell line to the inlet means of the upstream flotation cell.

3. A method of operating a flotation cell line that has a flotation cell line inlet means for receiving feed material to be processed in the flotation cell line and comprises an upstream flotation cell and at least first and second downstream flotation cells, each flotation cell having an inlet means for receiving feed material to be processed in the respective flotation cell and an outlet means for discharging waste material from the respective flotation cell, the outlet means of the upstream flotation cell being connected to the inlet means of the first downstream flotation cell and the outlet means of the first downstream flotation cell being connected to the inlet means of the second downstream flotation cell, said method comprising, in a first mode of operation, connecting the inlet means of the flotation cell line to the inlet means of the upstream flotation cell, supplying waste material of the upstream flotation cell as feed material to the first downstream flotation cell, and supplying waste material of the first downstream flotation cell as feed material to the second downstream flotation cell, whereby the feed material passes successively through the upstream flotation cell and the first and second downstream flotation cells, and in a second mode of operation, connecting the inlet means of the flotation cell line directly to the inlet means of at least one of said downstream flotation cells and supplying feed material of the flotation cell line directly to said one downstream flotation cell, whereby the feed material that is fed directly to the inlet means of said one downstream flotation cell by-passes the upstream flotation cell, and the method comprising operating the flotation cell line in the first mode when feed material is received at the inlet means of the flotation cell line at a material flow rate no higher than a predetermined limit, and operating the flotation cell line in the second mode in the event that the material flow rate exceeds said predetermined limit and supplying excess feed material directly to the inlet means of the first downstream flotation cell.

4. A method of operating a flotation cell line that has a flotation cell line inlet means for receiving feed material to be processed in the flotation cell line and comprises an upstream flotation cell and at least first and second downstream flotation cells, each flotation cell having an inlet means for receiving feed material to be processed in the respective flotation cell and an outlet means for discharging waste material from the respective flotation cell, the outlet means of the upstream flotation cell being connected to the inlet means of the first downstream flotation cell and the outlet means of the first downstream flotation cell being connected to the inlet means of the second downstream flotation cell, said method comprising, in a first mode of operation, connecting the inlet means of the flotation cell line to the inlet means of the upstream flotation cell, supplying waste material of the upstream flotation cell as feed material to the first downstream flotation cell, and supplying waste material of the first downstream flotation cell as feed material to the second downstream flotation cell, whereby the feed material passes successively through the upstream flotation cell and the first and second downstream flotation cells, and in a second mode of operation, connecting the inlet means of the flotation cell line directly to the inlet means of at least one of said downstream flotation cells and supplying feed material of the flotation cell line directly to said one downstream flotation cell, whereby the feed material that is fed directly to the inlet means of said one downstream flotation cell by-passes the upstream flotation cell, and the method comprising, in the second mode of operation, supplying feed material of the flotation cell line to the inlet means of the upstream flotation cell and the inlet means of one of said downstream flotation cells at substantially equal material flow rates.

5. A method of operating a flotation cell line that has a flotation cell line inlet means for receiving feed material to be processed in the flotation cell line and comprises at least first and second upstream flotation cells and at least one downstream flotation cells, each flotation cell having an inlet means and an outlet means, the outlet means of the first upstream flotation cell being connected to the inlet means of the downstream flotation cell and the outlet means of the second upstream flotation cell being connected to the inlet means of the downstream flotation cell, said method comprising, in a first mode of operation, connecting the inlet means of the flotation cell line to the inlet means of the first upstream flotation cell, whereby the feed material by-passes the second upstream flotation cell and passes successively through the first upstream flotation cell and the downstream flotation cell, and in a second mode of operation, supplying feed material both to the inlet means of the first upstream flotation cell and to the inlet means of the second upstream flotation cell, whereby the feed material that is fed to the inlet means of the second upstream flotation cell by-passes the first upstream flotation cell and passes successively through the second upstream flotation cell and the downstream flotation cell, and the method comprising, in the second mode of operation, supplying feed material to the inlet means of the first upstream flotation cell at a predetermined material flow rate and supplying any excess feed material received at the inlet means of the flotation cell line to the inlet means of the second upstream flotation cell.

6. A method of operating a flotation cell line that has a flotation cell line inlet means for receiving feed material to be processed in the flotation cell line and comprises at least first and second upstream flotation cells and at least one downstream flotation cells, each flotation cell having an inlet means and an outlet means, the outlet means of the first upstream flotation cell being connected to the inlet means of the downstream flotation cell and the outlet means of the second upstream flotation cell being connected to the inlet means of the downstream flotation cell, said method comprising, in a first mode of operation, connecting the inlet means of the flotation cell line to the inlet means of the first upstream flotation cell, whereby the feed material by-passes the second upstream flotation cell and passes successively through the first upstream flotation cell and the downstream flotation cell, and in a second mode of operation, supplying feed material both to the inlet means of the first upstream flotation cell and to the inlet means of the second upstream flotation cell, whereby the feed material that is fed to the inlet means of the second upstream flotation cell by-passes the first upstream flotation cell and passes successively through the second upstream flotation cell and the downstream flotation cell, and the method comprising, in the second mode of operation, supplying feed material to the inlet means of the second upstream flotation cell at a predetermined material flow rate and supplying any excess feed material received at the inlet means of the flotation cell line to the inlet means of the first upstream flotation cell.

7. A method of operating a flotation cell line that has a flotation cell line inlet means for receiving feed material to be processed in the flotation cell line and comprises at least first and second upstream flotation cells and at least one downstream flotation cells, each flotation cell having an inlet means and an outlet means, the outlet means of the first upstream flotation cell being connected to the inlet means of the downstream flotation cell and the outlet means of the second upstream flotation cell being connected to the inlet means of the downstream flotation cell, said method comprising, in a first mode of operation, connecting the inlet means of the flotation cell line to the inlet means of the first upstream flotation cell, whereby the feed material by-passes the second upstream flotation cell and passes successively through the first upstream flotation cell and the downstream flotation cell, and in a second mode of operation, supplying feed material both to the inlet means of the first upstream flotation cell and to the inlet means of the second upstream flotation cell, whereby the feed material that is fed to the inlet means of the second upstream flotation cell by-passes the first upstream flotation cell and passes successively through the second upstream flotation cell and the downstream flotation cell, and the method comprising operating the flotation cell line in the first mode when feed material is received at the inlet means of the flotation cell line at a material flow rate no higher than a predetermined limit, and operating the flotation cell line in the second mode in the event that the material flow rate exceeds said predetermined limit and supplying excess feed material to the inlet means of the second upstream flotation cell.

8. A method of operating a flotation cell line that has a flotation cell line inlet means for receiving feed material to be processed in the flotation cell line and comprises at least first and second upstream flotation cells and at least one downstream flotation cells, each flotation cell having an inlet means and an outlet means, the outlet means of the first upstream flotation cell being connected to the inlet means of the downstream flotation cell and the outlet means of the second upstream flotation cell being connected to the inlet means of the downstream flotation cell, said method comprising, in a first mode of operation, connecting the inlet means of the flotation cell line to the inlet means of the first upstream flotation cell, whereby the feed material by-passes the second upstream flotation cell and passes successively through the first upstream flotation cell and the downstream flotation cell, and in a second mode of operation, supplying feed material both to the inlet means of the first upstream flotation cell and to the inlet means of the second upstream flotation cell, whereby the feed material that is fed to the inlet means of the second upstream flotation cell by-passes the first upstream flotation cell and passes successively through the second upstream flotation cell and the downstream flotation cell, and the method comprising, in the second mode of operation, supplying feed material of the flotation cell line to the inlet means of the first upstream flotation cell and the inlet means of the second upstream flotation cell at substantially equal material flow rates.

* * * * *